US012460497B2

(12) United States Patent
Bu et al.

(10) Patent No.: US 12,460,497 B2
(45) Date of Patent: Nov. 4, 2025

(54) SYSTEMS AND METHODS FOR CONTROLLING HEAD TENSION

(71) Applicant: Schlumberger Technology Corporation, Sugar Land, TX (US)

(72) Inventors: Fanping Bu, Sugar Land, TX (US); Vassilis Varveropoulos, Katy, TX (US); Ken-Vidar Ditlefsen, Sugar Land, TX (US); Hisayo Tauchi, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/706,907

(22) PCT Filed: Dec. 14, 2022

(86) PCT No.: PCT/US2022/052808

§ 371 (c)(1),
(2) Date: May 2, 2024

(87) PCT Pub. No.: WO2023/121930

PCT Pub. Date: Jun. 29, 2023

(65) Prior Publication Data

US 2025/0020029 A1 Jan. 16, 2025

Related U.S. Application Data

(60) Provisional application No. 63/365,073, filed on May 20, 2022, provisional application No. 63/291,648, filed on Dec. 20, 2021.

(51) Int. Cl.
*E21B 23/14* (2006.01)
*E21B 19/00* (2006.01)

(52) U.S. Cl.
CPC ..... *E21B 23/14* (2013.01); *E21B 19/008* (2013.01)

(58) Field of Classification Search
CPC ..... E21B 19/008; E21B 23/14
See application file for complete search history.

(56) References Cited

U.S. PATENT DOCUMENTS

2009/0127525 A1 5/2009 Teurlay
2013/0138254 A1 5/2013 Seals
(Continued)

FOREIGN PATENT DOCUMENTS

WO 2015199720 A1 12/2015
WO 2021127288 A1 6/2021

OTHER PUBLICATIONS

Search Report and Written Opinion of International Patent Application No. PCT/US2022/052808; Dated Apr. 20, 2023; 9 pages.
(Continued)

*Primary Examiner* — Robert E Fuller
(74) *Attorney, Agent, or Firm* — Jeffrey D. Frantz

(57) ABSTRACT

A head wireline tension control system may determine a head tension based on a speed of the tool driving equipment and a cable speed of the cable as a function of an operation of the winch. A head tension regulation error may be determined based on a comparison of the head tension and a target head tension, and the head tension control system may operate the winch or the tool driving equipment according to an operating zone that includes the head tension regulation error. The operating zone may be defined by a first range of values for a difference between the speed of the tool driving equipment and the cable speed, and a first range of values for a difference between the head tension and the target head tension.

18 Claims, 14 Drawing Sheets

(56) References Cited

U.S. PATENT DOCUMENTS

| | | | |
|---|---|---|---|
| 2016/0215579 | A1 | 7/2016 | Van der Ende |
| 2021/0164309 | A1 | 6/2021 | Ludwig |

OTHER PUBLICATIONS

International Preliminary Report on Patentability of International Patent Application No. PCT/US2022/052808 dated Jul. 4, 2024, 8 pages.

SYSTEMS AND METHODS FOR CONTROLLING HEAD TENSION

CROSS REFERENCE TO RELATED APPLICATIONS

This application is a National Stage Entry of International Application No. PCT/US2022/052808, filed Dec. 14, 2022, which claims the benefit of U.S. Provisional Application No. 63/291,648 entitled "Systems and Methods for Controlling Head Tension," filed Dec. 20, 2021, and also claims the benefit of U.S. Provisional Application No. 63/365,073 entitled "Systems and Methods for Controlling Head Tension," filed May 20, 2022, which are entirely incorporated herein by reference.

BACKGROUND

In wireline systems employed in the oil and gas industry to perform operations in wellbores, movement and placement of tool strings may be facilitated by use of winches above ground, and tractors attached to the tool strings. As a tool string progresses through well bore, it may have occasion to enter into a highly inclined or horizontal section of a well where gravity cannot be relied upon for further conveyance down hole. External forces are required to push or pull the tool through the inclined or horizontal section. As a result, to move the tool further down hole, wireline operation using a winch is often supplemented by operation of a tractor.

During tractor operation, an operator must drive a winch, spool cable, adjust tractor arm force, and adjust tractor speed. All the while, the operator must monitor readings from pieces of equipment that sense and measure a multitude of operating parameters. This includes the monitoring and controlling of head tension, which is a critical measurement that corresponds to stretch (or slack) in a wireline cable and directly impacts the integrity of the cable. An operator must therefore be careful to maintain head tension within a set range, such as by adjusting winch or tractor speed while a tool string is conveyed to a desired location. But with all these factors to consider in moving of a tool string down hole as part of a wireline operation, particularly through horizontal sections of the well, an operator can become overwhelmed, make mistakes, and lose efficiency.

In pump down perforation, operators need to operate a hydraulic pump separately from a winch when conveying the tool downhole. Pump down perforating is a wireline-conveyed method of completing horizontal wells. Fluid pumped from surface is used to convey a plug and perforating guns to a desired depth, where the plug is set and guns are fired, creating tunnels through the casing and cement and into the formation. The perforations provide reservoir access for subsequent fracturing operations. In some examples, the pump can be used to drive a conveyance mechanism on the tool string, rather than using a mechanically driven tractor. In these examples, the same problems and complications exist with respect to managing cable tension.

As a result, a need exists for automation of various components of wireline system, such as a hydraulic pump, tractor, and/or a winch, to automate head tension control and improve operational efficiency, job execution consistency, operator/user experience through automation. The purpose of head tension control is to maintain head tension within a set range by adjust winch or tool speed while conveying tool to desired location.

SUMMARY

Examples described herein include systems and methods for regulating head tension in a wireline system. In one example, a wireline system may be suitable for use in the oil and gas industry and include a cable operatively attached to a winch and tool driving equipment, such as a tractor or a hydraulic pump. In one example, a head tension control system may determine a head tension based on a speed of the tool driving equipment and a cable speed of the cable as a function of an operation of the winch. A head tension regulation error may be determined based on a comparison of the head tension and a target head tension, and the head tension control system may operate the winch or the tool driving equipment according to an operating zone that includes the head tension regulation error. In one example, the operating zone may be defined by a first range of values for a difference between the speed of the tool driving equipment and the cable speed, and a first range of values for a difference between the head tension and the target head tension.

In another example, operating a winch or a tractor in an operating zone based on a head tension regulation error can reduce an actual difference between the speed of the tractor and the cable speed.

In another example, operating a winch or a hydraulic pump in an operating zone based on a head tension regulation error can reduce an actual difference between the speed of the pump and the cable speed.

In another example, an operating zone may include a first operating zone defined a range of values for a difference between a head tension and a target head tension from no head tension regulation error to a minimum head tension regulation error. According to an aspect of the present disclosure, operating a winch or a tool driving equipment may include allowing a current operation of the winch or the tool driving equipment to continue where a determined head tension regulation error falls with the first operating zone. According to another aspect of the present disclosure, a minimum head tension regulation error may correspond to plus or minus a value for a head tension measurement resolution for a head tensions control system.

According to an aspect of the present disclosure, a first component between a winch and a tractor may follow (be led by) a second component provided by other of the winch and the tractor. In one example, a head tension regulation error may correspond to a determined head tension being greater than a target head tension. Operating a winch or a tractor in an operating zone to reduce a head tension regulation error may include operating a first (following) component to have a first speed that is less than a second speed of a second (leading) component.

In yet another example, a head tension regulation error may correspond to a determined head tension being less than a target head tension. Operating a winch or a tractor in an operating zone to reduce a head tension regulation error may include operating a first (following) component to have a first speed that is greater than a second speed of a second (leading) component.

According to an aspect of the present disclosure, a first component between a winch and a surface hydraulic pump may follow (be led by) a second component provided by other of the winch and the surface hydraulic pump. In one example, a head tension regulation error may correspond to a determined head tension being greater than a target head tension. Operating a winch or a hydraulic pump in an operating zone to reduce a head tension regulation error may include operating a first (following) component to have a first speed that is less than a second speed of a second (leading) component.

In yet another example, a head tension regulation error may correspond to a determined head tension being less than a target head tension. Operating a winch or a hydraulic pump in an operating zone to reduce a head tension regulation error may include operating a first (following) component to have a first speed that is greater than a second speed of a second (leading) component.

In still other examples, a wireline system suitable for use in the oil and gas industry may include a winch, a tool string, a tractor operative connected to the tool string, a cable operatively connected to the winch and the tractor, and a head tension control system. In one example, the head tension control system may include a memory storage including a non-transitory, computer-readable medium comprising instructions, and a computing device including a hardware-based processor. The hardware-based processor may be configured to execute the instructions to carry out stages that include determining a head tension based on a speed of the tractor and a cable speed of the cable as a function of an operation of the winch. The stages may further include determining a head tension regulation error based on a comparison of the head tension and a target head tension, and operating one of the winch and the tractor according to an operating zone including the head tension regulation error. In one example, the operating zone may be defined by a first range of values for a difference between the speed of the tractor and the cable speed, and a first range of values for a difference between the head tension and the target head tension.

In another examples, a wireline system suitable for use in the oil and gas industry may include a winch, a tool string, a hydraulic pump operative connected to the tool string, a cable operatively connected to the winch and the hydraulic pump, and a head tension control system. In one example, the head tension control system may include a memory storage including a non-transitory, computer-readable medium comprising instructions, and a computing device including a hardware-based processor. The hardware-based processor may be configured to execute the instructions to carry out stages that include determining a head tension based on a pumping rate and a cable speed of the cable as a function of an operation of the winch. The stages may further include determining a head tension regulation error based on a comparison of the head tension and a target head tension, and operating one of the winch and the hydraulic pump according to an operating zone including the head tension regulation error. In one example, the operating zone may be defined by a first range of values for a difference between the pump rate and the cable speed, and a first range of values for a difference between the head tension and the target head tension.

The examples summarized above can each be incorporated into a non-transitory, computer-readable medium having instructions that, when executed by a processor associated with a computing device, cause the processor to perform the stages described. Additionally, the example methods summarized above can each be implemented in a system including, for example, a memory storage and a computing device having a processor that executes instructions to carry out the stages described.

The examples summarized above can each be applied with the use of various types of tool driving equipment, including tractors, hydraulic pumps, and/or devices that utilize pressurized fluid supplied from a hydraulic pump to drive mechanical components of the devices.

Both the foregoing general description and the following detailed description are exemplary and explanatory only and are not restrictive of the examples, as claimed.

DESCRIPTION OF THE EXAMPLES

Reference will now be made in detail to the present examples, including examples illustrated in the accompanying drawings.

Figure 1:
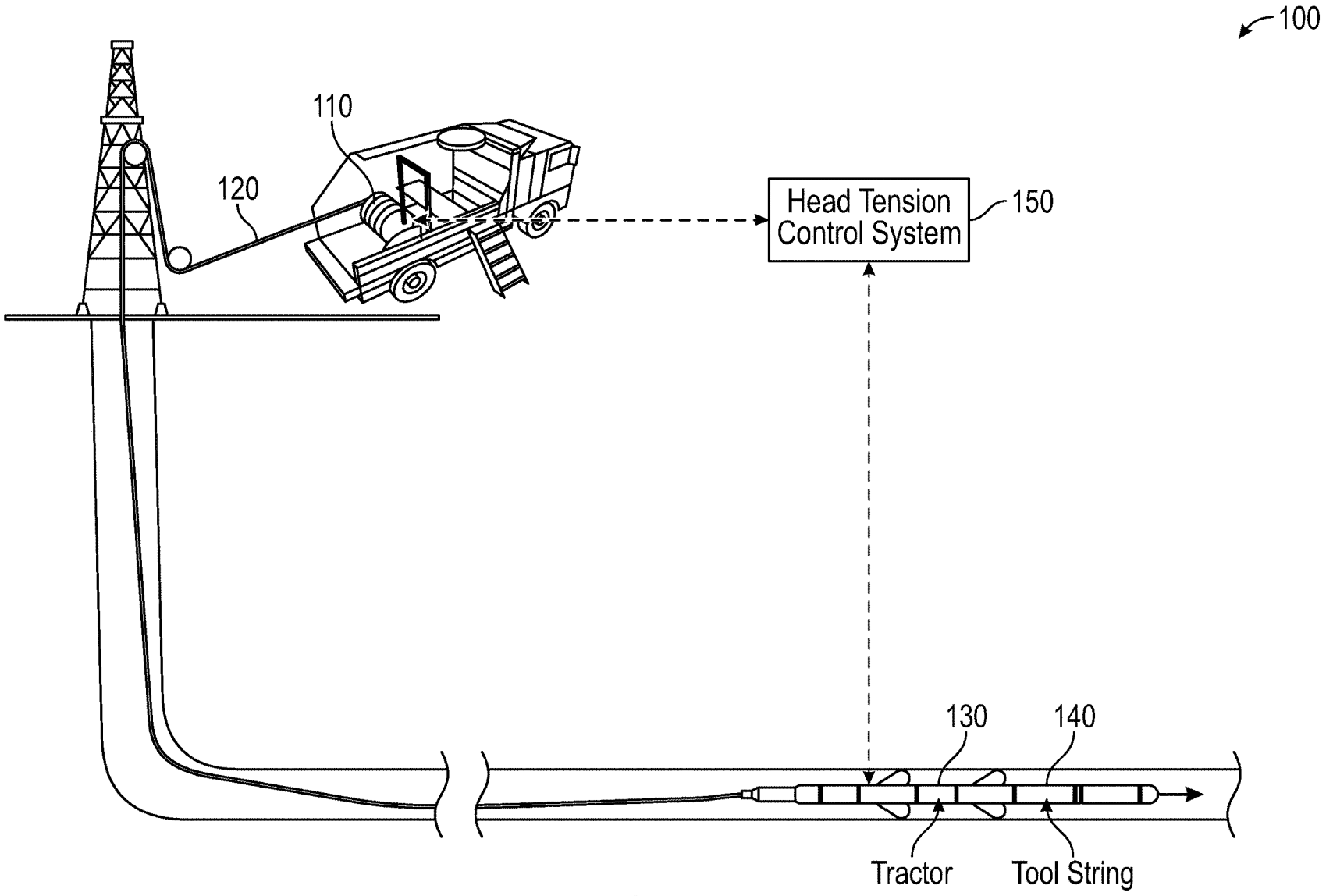
FIG. 1 is an illustration of an exemplary wireline system suitable for use in oil and gas operations, according to as aspect of the present disclosure.

FIG. 1 is an illustration of an exemplary wireline system 100 suitable for use in oil and gas operations, according to as aspect of the present disclosure. The wireline system 100 may include: a winch 110; a cable 120 (also referred to as a wireline) attached to and extending from the winch 110; a tractor 130 attached to an end of the cable 120 opposite an end attached to the winch 110; and a tool string 140 operatively connected to the tractor 130. According to another aspect of the present disclosure, the wireline system 100 may include a head tension control system 150 incorporated in or in communication with the winch 110, the tractor 120, or both.

In one example, wireline system 100 operation may include driving the winch 110 to wind or unwind the cable 120, adjusting tractor arm force and tractor speed, and monitoring sensing equipment measuring certain operational parameters such as surface tension and head tension. In one example, the monitoring sensing equipment with one, more than one, or all of these components incorporated in or in communication with the winch 110, the tractor 130, and/or the head tension control system 150. In various examples discussed herein, the head tension control system is configured to maintain head tension within a set range by adjusting a speed of the winch 110 and/or the tractor 130 while the tool string 140 is conveyed to desired location. As a result, implementation of the head tension control system 150 may improve operational efficiency, job execution consistency, and user experience of the wireline system 100 operations by transforming operation of the tractor 130 into a series of one or more automated processes. Furthermore, the head tension control system 150 can provide these operational advantages in one of several ways as discussed in more detail below.

Figure 2:
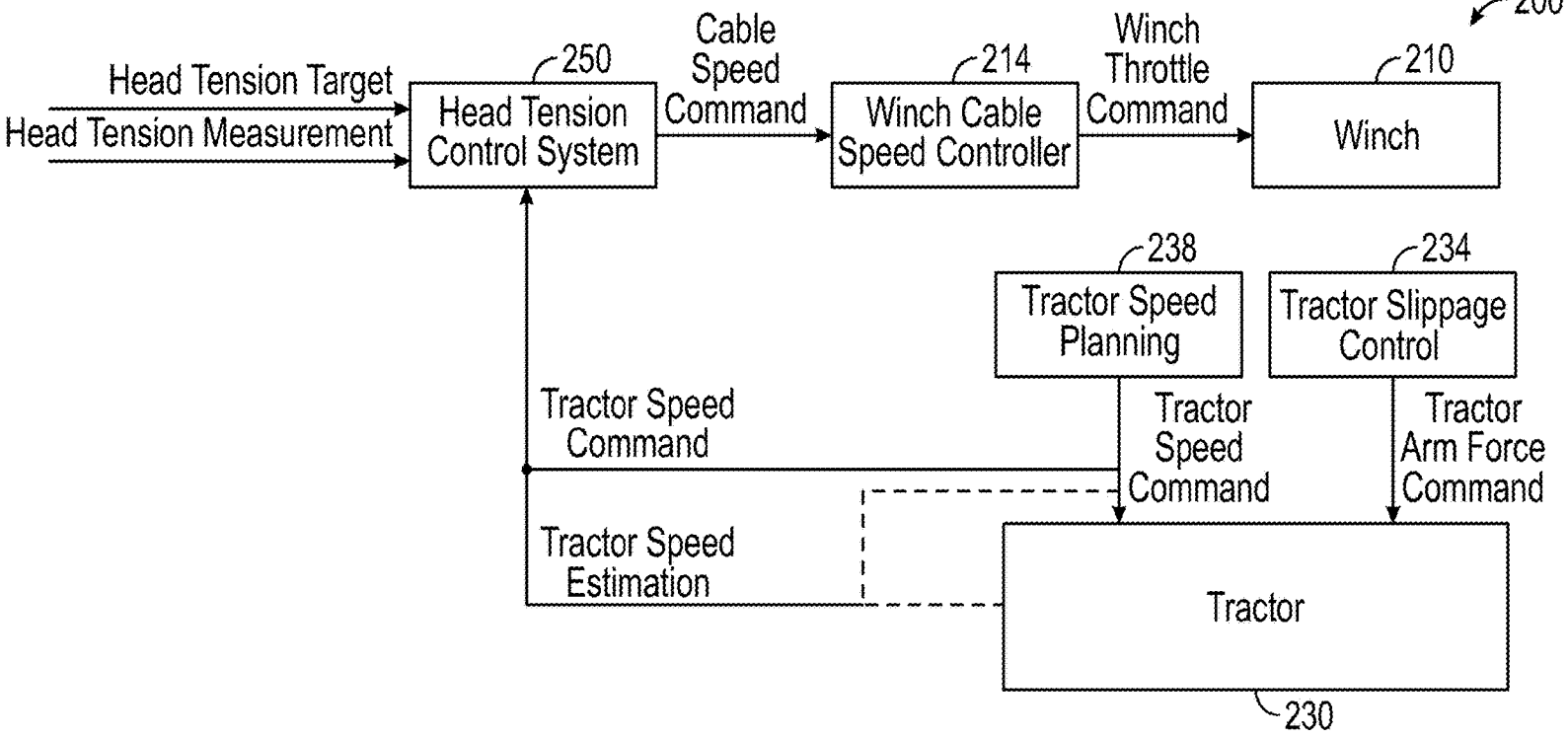
FIG. 2 is a schematic of an exemplary wireline system including a head tension control system, according to an aspect of the present disclosure.

FIG. 2 is a schematic of an exemplary wireline system 200 including a head tension control system 250, according to an aspect of the present disclosure. In the wireline system 200 of FIG. 2, a tractor 230 is operated independently of a winch 210. A tractor speed planning control 238 may be configured to generate and transmit a tractor speed command to the tractor 230 causing the tractor 230 to operate at a desired speed. In addition, the tractor speed planning control 238 may stop the tractor 230 smoothly when the tractor 230 approaches and eventually reaches a desired target position with a well. A tractor slippage control 234 may adjust a tractor arm force command so that tractor slippage is controlled within a target range.

The winch 210 on the other hand, may be controlled via a head tension control system 250 to follow the motion of the tractor 230 based on a regulation of a head tension measurement to be within a set target range. In one example, the head tension control system 250 may access, or otherwise be provided with, a tractor speed command from the tractor speed planning control 238 and/or an estimated speed of the tractor 230 from: the tractor speed planning control 238; the tractor 230; or a sensor installed on or otherwise monitoring the motion of the tractor 230. Using these parameters, the head tension control system 250 can calculate or otherwise obtain a head tension measurement, which the head tension control system may use to calculate a surface cable speed command.

The calculated cable speed command may be transmitted a winch cable speed controller 214 that then uses the cable speed command to issue a winch throttle command to control the winch 210. The winch speed controller may continuously modulate the winch throttle command in order to control the winch 210 to follow the received cable speed command as close as possible. In one example, the winch 210 may be a hydraulic winch and the winch speed controller 214 control operation of the winch in accordance with the systems, methods, and mechanisms detailed in International Application No. PCT/US2020/065771, published as International Publication No. WO2021/127288 on Jun. 24, 2021, the entirely of which is incorporated by reference herein for all purposes.

The wireline system may include: a winch; a cable attached to and extending from the winch; a surface pump; and a tool string operatively connected to the pump. According to another aspect of the present disclosure, the wireline system may include a head tension control system incorporated in or in communication with the winch, the pump, or both.

In some embodiments, the pump pushes the tool string within the wellbore based on creating a pressure differential between the upstream and downstream portions of the wellbore relative to the tool string. In other words, the pump can increase the pressure within the wellbore between the surface and the tool string, causing the tool string to move. In another embodiment, the pump feeds pressurized fluid to a component coupled to the tool string, where the component is configured to utilize the pressurized fluid to produce motion. For example, the component can eject the pressurized fluid in one or more directions that produce the desired motion. In another example, the component can use the pressurized fluid to actuate a mechanical device that produces motion, such as wheels or a hydraulic actuator. In either case, the pumping rate from the pump can determine the speed at which the tool string 340 advances within the wellbore.

In one example, wireline system operation may include driving the winch to wind or unwind the spool cable, adjusting pump rate, and monitoring sensing equipment measuring certain operational parameters such as surface tension and head tension. In one example, the monitoring sensing equipment with one, more than one, or all of these components incorporated in or in communication with the winch, the pump, and/or the head tension control system. In various examples discussed herein, the head tension control system is configured to maintain head tension within a set range by adjusting a speed of the winch and/or the pump while the tool string is conveyed to desired location. As a result, implementation of the head tension control system may improve operational efficiency, job execution consistency, and user experience of the wireline system operations by transforming operation of the pump into a series of one or more automated processes. Furthermore, the head tension control system can provide these operational advantages in one of several ways as discussed in more detail below.

In an exemplary wireline system, similar to FIG. 2, but with the tool being driven by a hydraulic surface pump. In the wireline system, a pump is operated independently of a winch. A tool speed planning module may be configured to generate and transmit a tool speed command to the pump, causing the pump to accelerate to a desired speed. The tool speed planning module sends the tool speed command to a tool speed control module, which can interpret the command and generate an appropriate pumping rate command for the surface pump. The tool speed control module can thereby vary the pumping rate of the surface pump based on a tool speed command from the tool speed planning module.

The winch on the other hand, may be controlled via a head tension control system to follow the motion of the pump based on a regulation of a head tension measurement to be within a set target range. In one example, the head tension control system may access, or otherwise be provided with, a tool speed command from the tool speed planning control and/or an estimated speed of the pump from: the tool speed planning control; the pump; or a sensor installed on or otherwise monitoring the motion of the pump. Using these parameters, the head tension control system can calculate or otherwise obtain a head tension measurement, which the head tension control system may use to calculate a surface cable speed command.

The calculated cable speed command may be transmitted to a winch cable speed controller that then uses the cable speed command to issue a winch throttle command to control the winch. The winch speed controller may continuously modulate the winch throttle command in order to control the winch to follow the received cable speed command as close as possible. In one example, the winch may be a hydraulic winch and the winch speed controller controls operation of the winch in accordance with the systems, methods, and mechanisms detailed in International Application No. PCT/US2020/065771, published as International Publication No. WO2021/127288 on Jun. 24, 2021, the entirely of which is incorporated by reference herein for all purposes.

Much information can be gathered before and during operation. That information includes: (1) well properties include inclination, surface friction coefficients, liquids inside and their properties; (2) tool physical properties such as weight and geometric dimension; (3) cable properties include line weight and stiffness; and (4) packer physical and geometric properties for pumpdown perforating.

Commands sent from surface includes: (1) for tractor operation, it could include tractor speed command, surface voltage and tractor arm command; and (2) for pumpdown perforating, it could include pumping rate command. Surface measurements include: cable speed and tension; and surface pressure for pumpdown perforating. Downhole measurements may vary depending on the tools, but could include CCL, Gamma ray, head tension, measurements from inertial sensor such as accelerometer and gyroscope, and measurements from magnetometers.

To use the information, a tool states estimation 405 is created to generate estimation of tool position, speed, and head tension for head tension control from the information. A variety of algorithms such as Luenberger observer, Kalman filter and moving horizon estimation can be used for state estimation.

Figure 3:
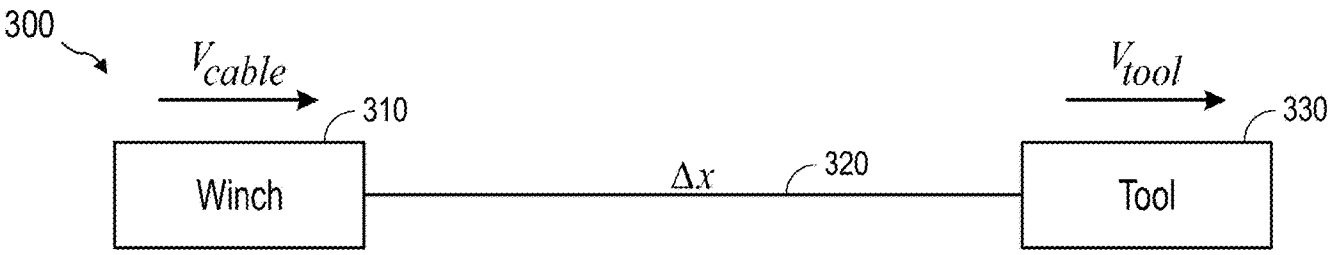
FIG. 3 illustrates a block diagram providing an exemplary characterization of cable tension for wireline system as a relationship between a speed of a cable of a winch and a speed of a tool.

FIG. 3 illustrates a block diagram 300 providing an exemplary characterization of cable tension for a wireline system as a relationship between a speed of a cable of a winch 310 ($v_{cable}$) and a speed of a tool 330 ($v_{tool}$). More specifically, FIG. 3 illustrates a simplified explanation of how tension is generated in a cable of a wireline system.

In practice, the winch 310 may release a cable 320 at a speed of $v_{cable}$ from a surface where a well is provided. The tool 330 may pull the cable 320 at the speed $v_{tool}$. A difference between two speed creates stretch (or slack) in the cable 320 reflected as cable tension. According to one example of the present disclosure a Lyapunov function may be used to define, or otherwise characterize a transfer of energy resulting from the tractor pulling the cable 320 at the speed $v_{tool}$ and the winch 310 may release a cable 320 at a speed of $v_{cable}$. More specifically the Lyapunov function is as follows:

$$V = \frac{1}{2}k(\Delta x - \Delta x_d)^2 \tag{1}$$

where k is a positive number, $\Delta x$ is cable stretch, and $\Delta x_d$ represents the cable stretch at target head tension.

To regulate head tension at target tension, the derivative of Lyapunov function (1) should be negative:

$$\dot{V} = k(\Delta x - \Delta x_d)\frac{d(\Delta x)}{dt} = k(\Delta x - \Delta x_d)(v_{tractor} - v_{cable}) < 0 \tag{2}$$

In one example, an exemplary head tension control system according to an aspect of the present disclosure may use the Lyapunov function in accordance with the derivative operation above to command a winch to regulate head tension according to the following exemplary control scheme:

I. Where $\Delta x - \Delta x_d > 0$, the head tension control system—
  A. recognizes:
    1. a head tension measurement is larger than target tension,
    2. $v_{tool} - v_{cable} < 0$, and
  B. controls a surface cable speed $v_{cable}$ to be less than tool speed $v_{tool}$($v_{tool} - v_{cable} > 0$); and II. Where $\Delta x - \Delta x_d$?<0, the head tension control system—
  A. recognizes:
    1. a head tension measurement is smaller than target tension
    2. $v_{tool} - v_{cable} > 0$, and
  B. controls surface cable speed $v_{cable}$ to be bigger than tool speed $v_{toil}$($v_{tool} - v_{cable} < 0$).

Figure 4:
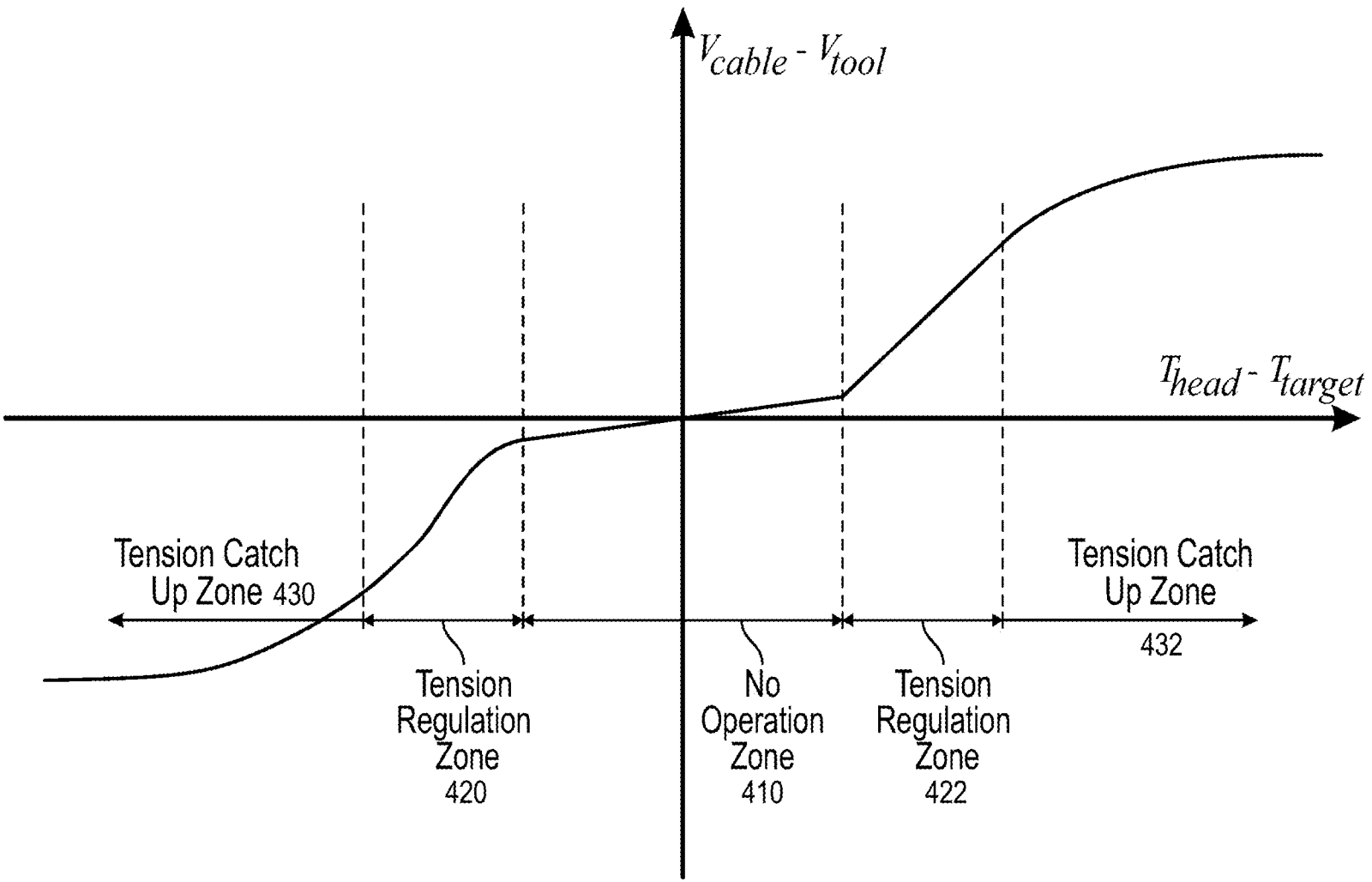
FIG. 4 illustrates an exemplary control curve for operating components of a wireline system based on head tension regulation error and a difference between a command speed for following component and measured speed of a lead component.

FIG. 4 illustrates an exemplary control curve for operating components of a wireline system based on head tension regulation error and a difference between a command speed for following component and measured speed of a lead component. More specifically, implementation of the above control scheme may include a surface cable speed command $v_{cable}$ be chosen in accordance with the zones illustrated.

In FIG. 4, the:

x-axis represents a head tension regulation error:

$$T_{head} - T_{target}, \text{ where} \tag{3}$$

$T_{head}$ is a head tension measurement, and $T_{target}$ is a target head tension; and y-axis represents a difference between:

$$v_{cable} - v_{tool}, \text{ where}$$

$v_{cable}$ is a surface cable speed command, and $v_{tool}$ is a tool speed

Depending on a magnitude of a difference between the head tension measurement $T_{head}$ and target head tension $T_{target}$, the head tension control system operates wireline system components according to three zones:

I. No operation zone (zone 410 of FIG. 4; zone 510 of FIG. 5)—the head tension control system:
  A. recognizes the head tension regulation error is small, and
  B. regulates the cable speed command $v_{cable}$ to be:
    1. the same as the tool speed $v_{tool}$, or
    2. the tool speed $v_{tool}$ plus a very small feedback term based on the head tension regulation error;

II. Tension regulation zone (zones 420, 422 of FIG. 4; zones 520, 522 of FIG. 5)—the head tension control system:
  A. recognizes head tension regulation error is of a modest magnitude, and
  B. regulates a feedback part of cable speed command $v_{cable}$ to have a large gain; and III. Tension catching up zone (zones 430, 432 of FIG. 4; zones 530, 532 of FIG. 5)—the head tension control system:
  A. recognizes a head tension regulation error is large, and
  B. regulates a feedback portion of a cable speed command to be saturated smoothly toward a constant and avoid oscillation.

Figure 5:
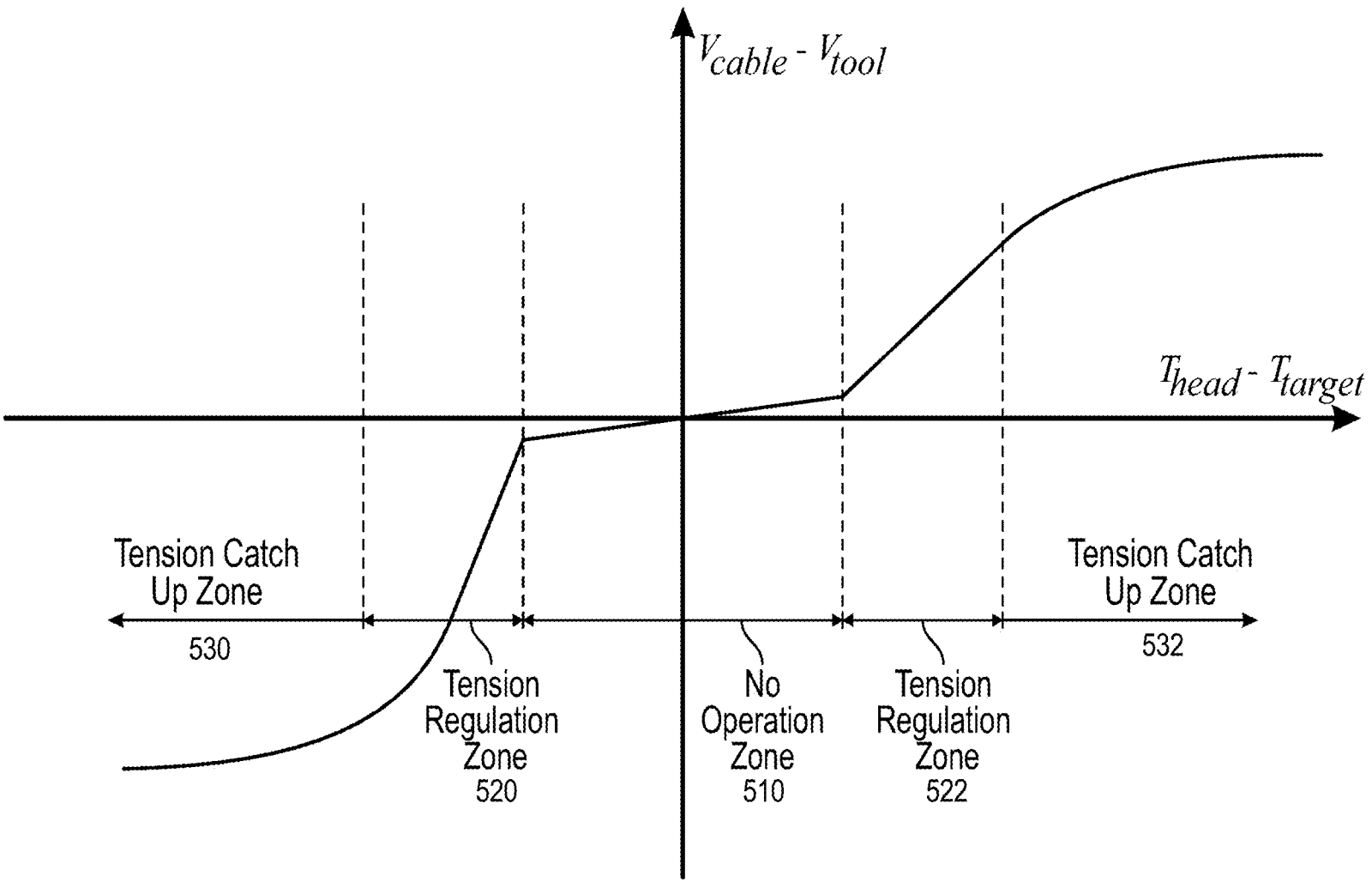
FIG. 5 illustrates an exemplary control curve for operating components of a wireline system based on head tension regulation error and a difference between a command speed for following component and measured speed of a lead component.

FIG. 5 illustrates an exemplary control curve for operating components of a wireline system based on head tension regulation error and a difference between a command speed for a following component and measured speed of a lead component. In another example, a head tension control system according to an aspect of the present can implement an asymmetric control curve to avoid cable slack during tool operation.

As illustrated a winch may be controlled more aggressively to slow down than accelerate. Due to a transmission bandwidth of a wireline cable, a head tension measurement from downhole tractor may have less than optimal resolution. As a result, a head tension control system according to the present disclosure can modulate sizes (ranges) of different control zones based on a resolution of a head tension measurement. In one example, a no operation zone can be set to be +/− a head tension resolution. In another example, acceleration or deceleration portions of tension regulation zones can be set by a head tension control system to one (1) or two (2) times a head tension resolution.

Figure 6:
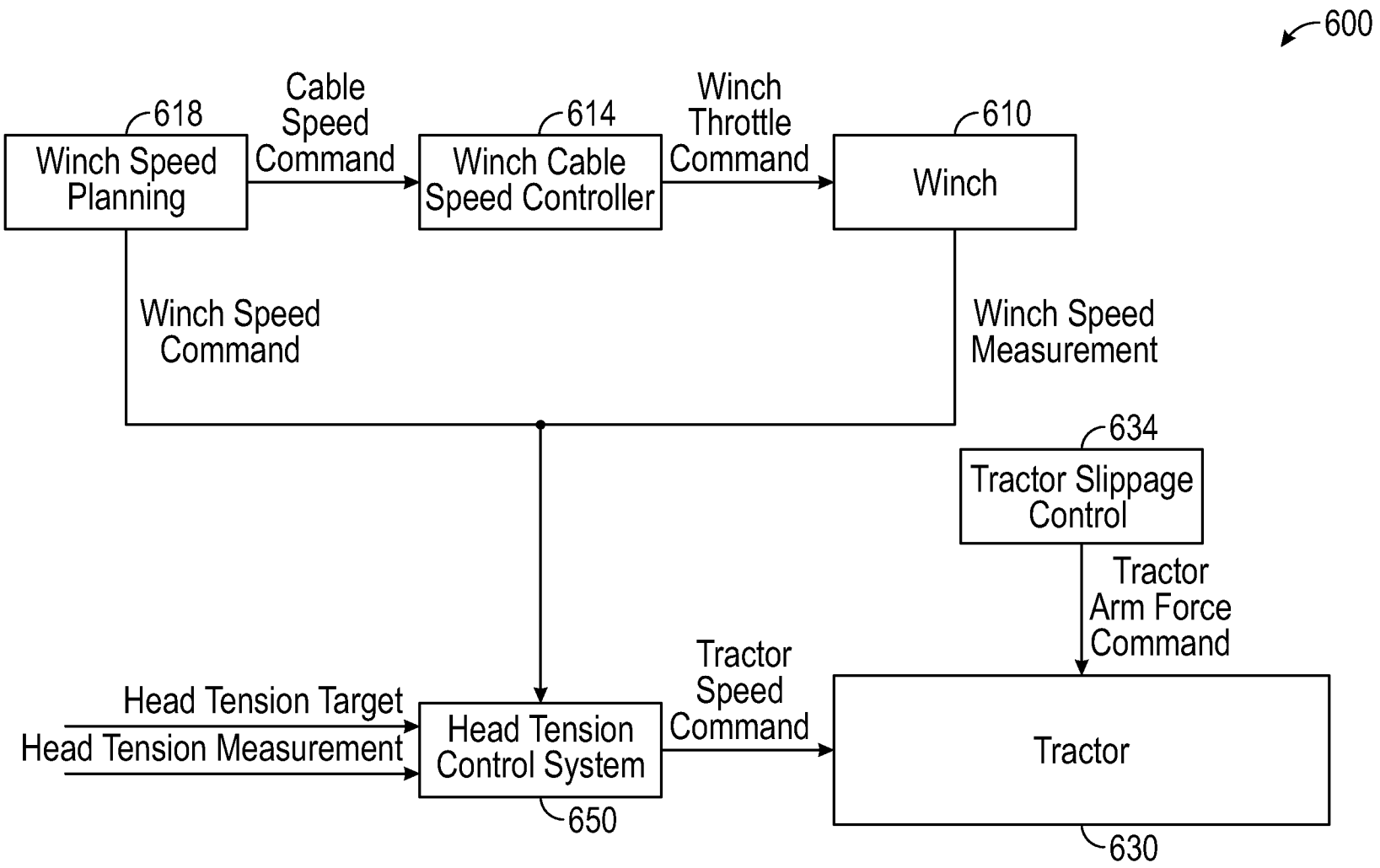
FIG. 6 is a schematic of an exemplary wireline system including a head tension control system, according to an aspect of the present disclosure.

FIG. 6 is a schematic of an exemplary wireline system 600 including a head tension control system 650, according to an aspect of the present disclosure. A winch 610 of the wireline system 600 may be controlled independently. More specifically, a winch speed planning module 618 may transmit a cable speed command to accelerate the winch 610 to a desired speed, and stop the winch 610 smoothly when a tool including a tractor 630 reaches desired location. For example, the winch speed planning module 618 can transmit the cable speed command to a winch cable speed controller 614, which can translate the command into a which throttle command that directly commands the winch 610 to adjust its speed.

In one example, the tractor 630 may be controlled to follow the motion of the winch 610 such that a head tension measurement will be regulated within set target range by the head tension controller. The head tension control system 650 may utilize winch speed command/measurement and head tension measurement to calculate a tractor speed command or a pump rate command when the driving tool is a surface pump. In addition, a tractor slippage control 634 may adjust a tractor arm force command such that the tractor slippage is controlled within a target range.

The head tension control system 650 of the wireline system 600 of FIG. 6 may be designed in the similar way as the exemplary head tension control system 250 of FIG. 2, in which the tractor 230 of the wireline system 200 leads with the winch 210 following. However, in the wireline system 600 of FIG. 6, instead of determining and issuing a winch cable speed command, the head tension control system 650 utilizes $T_{head}$, $T_{target}$, $v_{cable}$, and $v_{tractor}$ to determine a tractor speed command to control the operation of the tractor 630.

Figure 7:
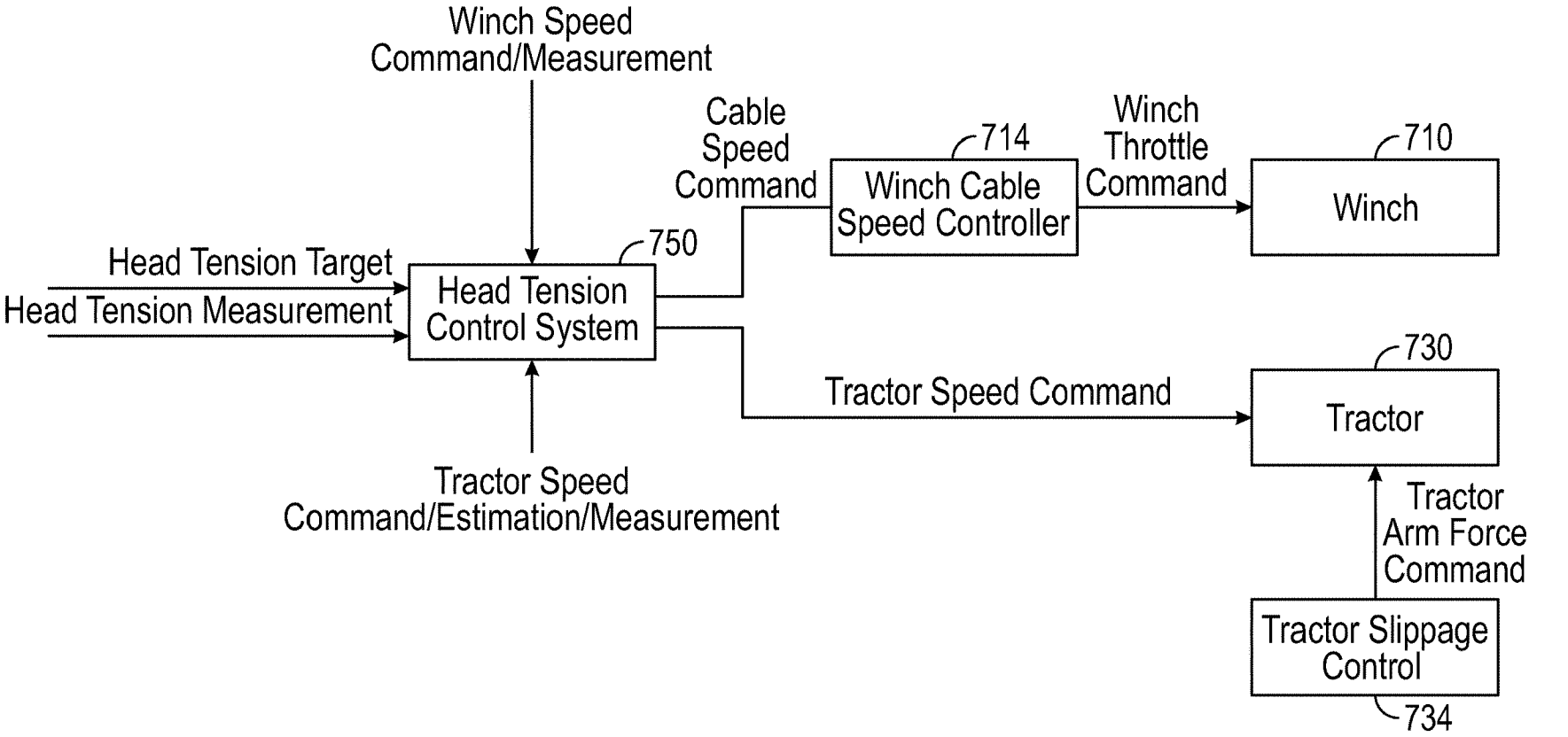
FIG. 7 is a schematic of an exemplary wireline system including a head tension control system, according to an aspect of the present disclosure.

FIG. 7 is a schematic of an exemplary wireline system 700 including a head tension control system 750, according to an aspect of the present disclosure.

In the wireline system 700 of FIG. 7, both a winch 710 and a tractor 730 may be controlled to move by the head tension control system 750. Either of the winch 710 and the tractor 730 may be controlled by the head tension control system 750 to: (A) follow movement of the other of the winch 710 and the tractor 730 (the leader); and (B) regulate a head tension measurement. In one example, a multiple-input-multiple-output (MIMO) control of the wireline system 700 may decoupled sequentially into two single-input-single-output (SISO) control sequences. In another example, the head tension control system 750 may be configured to control motion of both the tractor 730 and the winch 710 simultaneously, or both the tractor 730 and the winch 710 may be controlled to move coordinately. As a result of the comprehensive control implemented by the head tension control system 750, cable surface tension regulation, along with head tension regulation, may be achieved.

Figure 8:
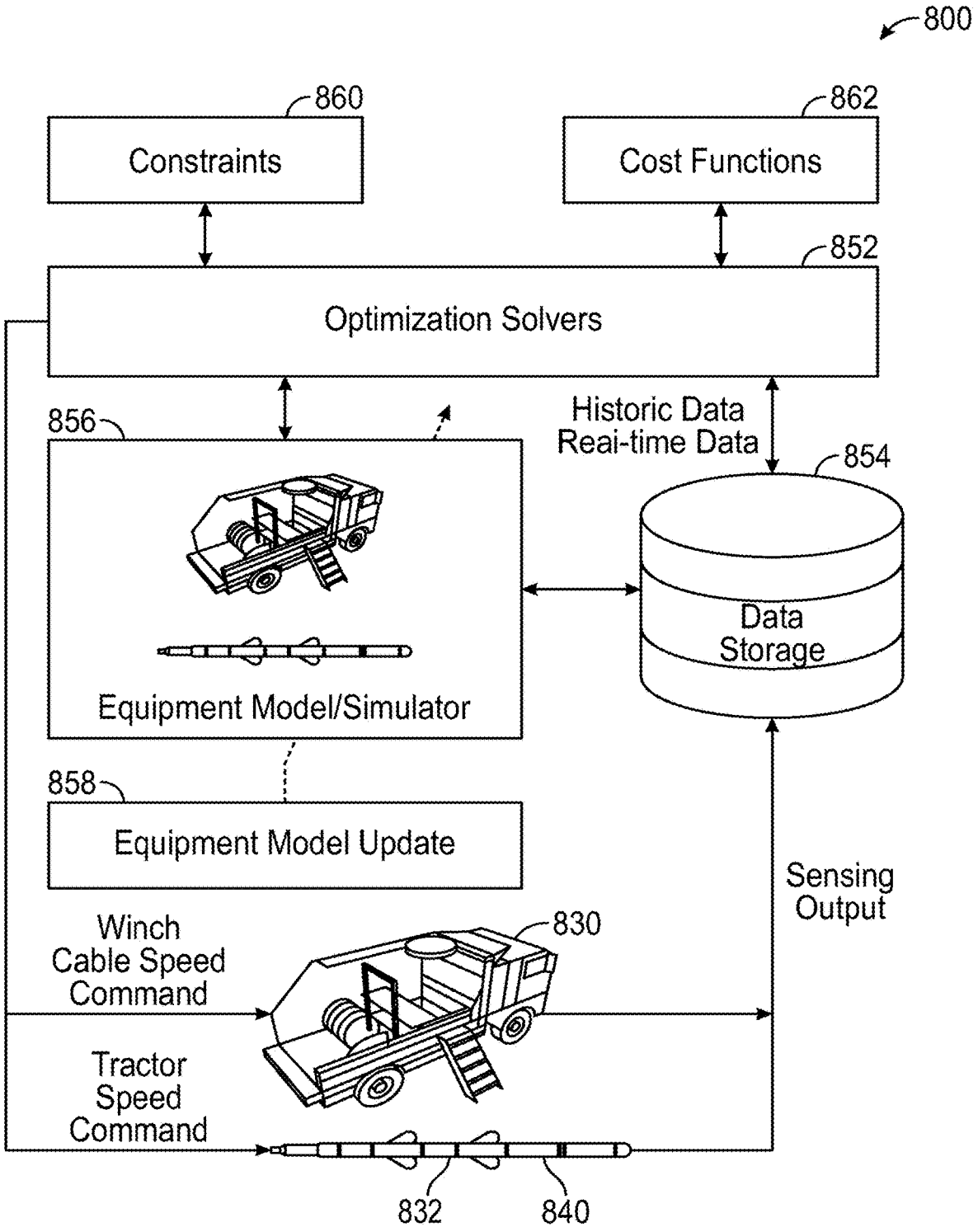
FIG. 8 is an illustration of an exemplary system for performing coordinated wireline system component control utilizing an exemplary predictive control framework.

FIG. 8 is an illustration of an exemplary system 800 for performing coordinated wireline system component control, as with the wireline system 700 of FIG. 7, utilizing an exemplary predictive control framework to control a winch 830.

The head tension control system 750 may utilize a Model Predictive Control (MPC) scheme and include components as shown in FIG. 8. More specifically, the head tension control system may incorporate an optimization solver 852, a data storage component 854 (e.g., a database or other data storage repository provided by a hardware-based and/or cloud-based server or other computing device), and an equipment model/simulator 856. In other examples, equipment model updating service 858 may be incorporated in or by the head tension control system 750 of FIG. 7 as a standalone service or as part of the optimization solver 852, the data storage component 854, or the equipment model/simulator 856.

According to one aspect of the present disclosure, the head tension control system 750 may account for objective functions 862 and constraints 860 in its role in the operation of a wireline system such as the wireline system 700 of FIG. 7. In one example, objective functions 862 can be a weighted sum of head tension regulation error and tool speed following error. Constraints 860 can be surface tension limits, winch speed limits, winch acceleration/deceleration limits, tractor speed limits, and/or tractor acceleration/deceleration limits. Depending on the equipment used to drive the tool, constraints could also include tool speed limits and acceleration/deceleration limits.

In one example, the equipment model/simulator 856 may include or embody a parametrized mathematical representation of a piece of equipment's dynamic behavior under past, current, or estimated well conditions, including that of a winch 830, a tractor 832, a tool string 840, and cable. Model parameters may be updated using historic and real-time data. The optimization solver 852 may therefore use the historic and real-time data to predict future equipment behavior.

According to an aspect of the present disclosure, the optimization solver 852 may operate to determine optimal solutions for winch cable and tractor speed commands for a future time interval using data from the equipment model/simulator 856. More specifically, the optimization solver 852 may generate speed commands that define part of optimal solutions that minimize defined objective functions and satisfy designed constraints. These optimal solutions (e.g., speed commands) may be sent to the winch 830 and the tractor 832 for execution.

Figure 9:
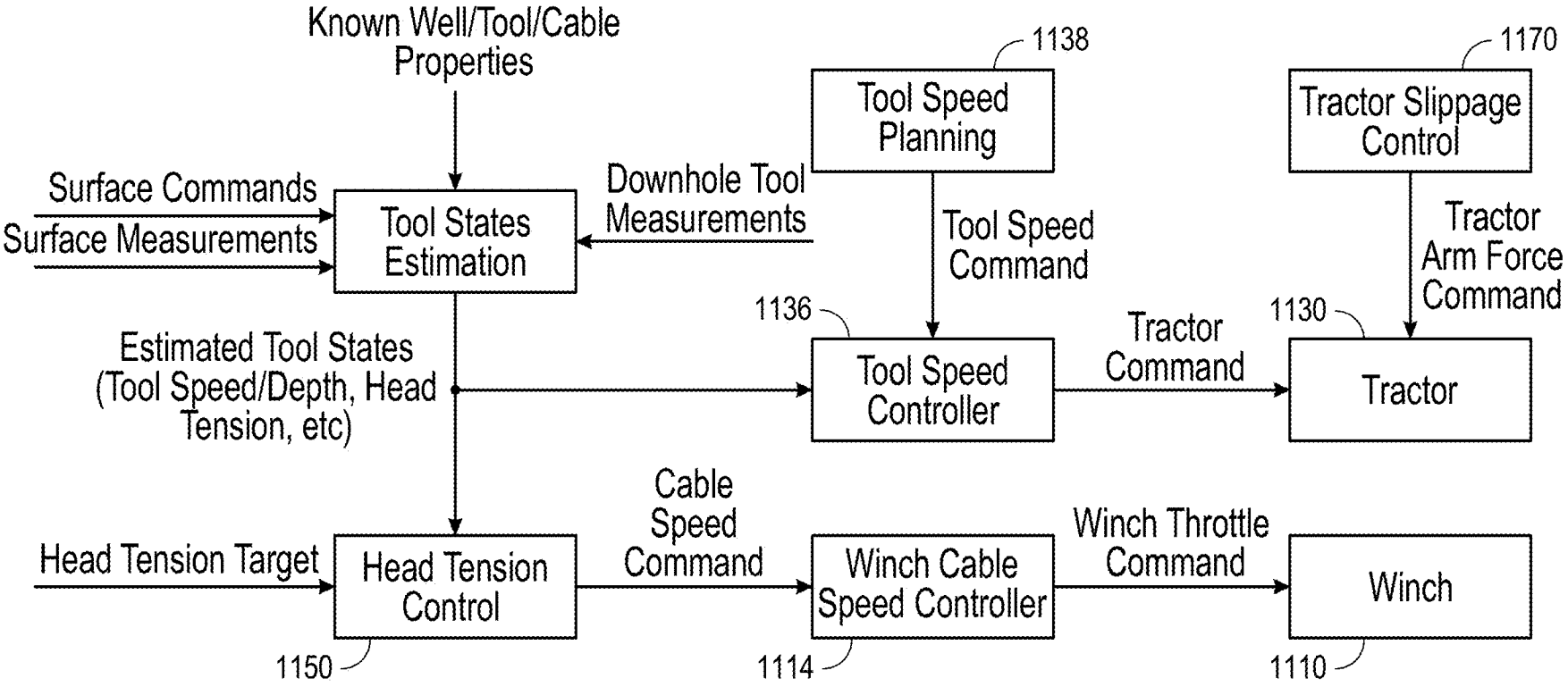
FIG. 9 is a schematic of an exemplary wireline system including a head tension control system, according to an aspect of the present disclosure.

FIG. 9 is a schematic of an exemplary wireline system 1100 including mechanisms for controlling a winch 1110 and a tractor 1130, according to an aspect of the present disclosure. The example system of FIG. 9 has a tool speed controller 1136 and tractor slippage controller 1170 controlling the tractor 1130. In the wireline system 1100 of FIG. 9, a tractor 1130 is operated independently of a winch 1110. A tool speed planning module 1138 may be configured to generate and transmit a tool speed command to a tool speed controller 1136, causing the tool speed controller 1136 to interpret the command and send a corresponding tractor command to the tractor 1130 to accelerate or decelerate to a desired speed. The tool speed controller 1136 can thereby vary the speed of the tractor 1130 based on a tool speed command from the tool speed planning module 1138.

The tractor 1130 can also be controlled by a tractor slippage controller 1170 that can provide a tractor arm force command so that tractor slippage is controlled within a target range. This command can be generated based on receiving data from the tractor 1130 or a sensor associated with the tractor 1130 indicating that the tractor 1130 is experiencing slippage beyond an acceptable range.

The winch 1110 on the other hand, may be controlled via a head tension control system 1150 to follow the motion of the tractor 1130 based on a regulation of a head tension measurement to be within a set target range. In one example, the head tension control system 1150 may access, or otherwise be provided with, a tool speed command from the tool speed planning control 1138 and/or an estimated speed of the tractor 1130 from the tool speed planning control 1138 or a sensor installed on or otherwise monitoring the motion of the tractor 1130. Using these parameters, the head tension control system 1150 can calculate or otherwise obtain a head tension measurement, which the head tension control system may use to calculate a surface cable speed command.

The calculated cable speed command may be transmitted to a winch cable speed controller 1114 that then uses the cable speed command to issue a winch throttle command to control the winch 1110. The winch speed controller 1114 may continuously modulate the winch throttle command in order to control the winch 1110 to follow the received cable speed command as close as possible. In one example, the winch 1110 may be a hydraulic winch and the winch speed controller 1114 controls operation of the winch in accordance with the systems, methods, and mechanisms detailed in International Application No. PCT/US2020/065771, published as International Publication No. WO2021/127288 on Jun. 24, 2021, the entirely of which is incorporated by reference herein for all purposes.

Much information can be gathered before and during operation. That information includes: (1) well properties include inclination, surface friction coefficients, liquids inside and their properties; (2) tool physical properties such as weight and geometric dimension; (3) cable properties include line weight and stiffness; and (4) packer physical and geometric properties for pumpdown perforating.

Commands sent from surface includes: (1) for tractor operation, it could include tractor speed command, surface voltage and tractor arm command; and (2) for pumpdown perforating, it could include pumping rate command. Surface measurements include: cable speed and tension; and surface pressure for pumpdown perforating. Downhole measurements may vary depending on the tools, but could include CCL, Gamma ray, head tension, measurements from inertial sensor such as accelerometer and gyroscope, and measurements from magnetometers.

To use the information, a tool states estimation 1105 is created to generate estimation of tool position, speed, and head tension for head tension control from the information. A variety of algorithms such as Luenberger observer, Kalman filter and moving horizon estimation can be used for state estimation.

Figure 10:
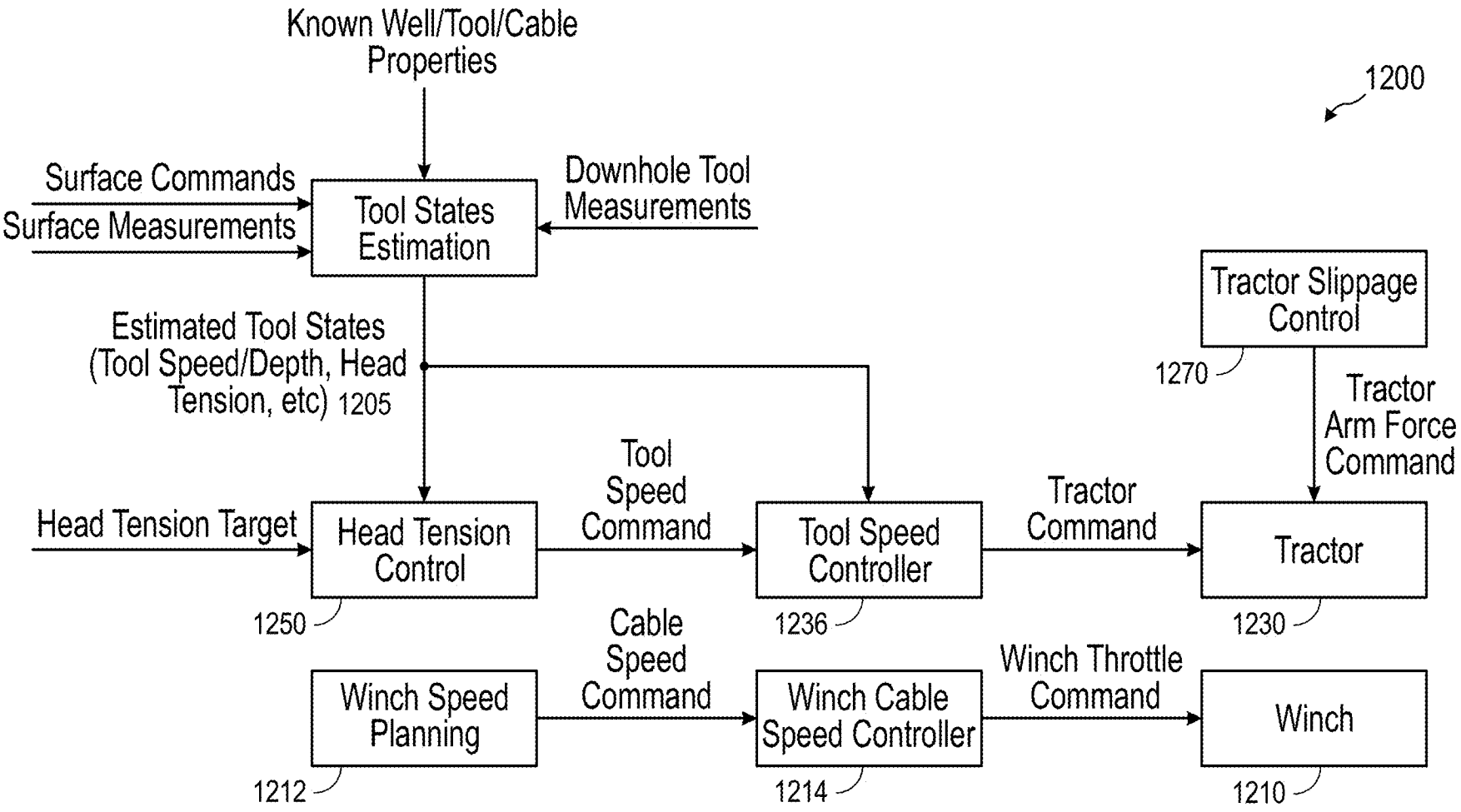
FIG. 10 is a schematic of an exemplary wireline system including a head tension control system, according to an aspect of the present disclosure.

FIG. 10 is a schematic of an exemplary wireline system 1200 including a head tension control system 1250, according to an aspect of the present disclosure. The system 1200 of FIG. 10 is similar to the system 1100 of FIG. 9, but system 1200 does not utilize a tool speed planning module, instead utilizing a winch speed planning module 1212. In the wireline system 1200 of FIG. 10, a tractor 1230 is operated independently of a winch 1210. A winch speed planning module 1212 may be configured to generate and transmit a cable speed command to a winch cable speed controller 1214, causing the winch cable speed controller 1214 to interpret the command and send a corresponding winch throttle command to the winch 1210 to accelerate or decelerate the cable speed to be within a desired speed range. The winch cable speed controller 1214 can thereby vary the speed of the winch 1210 based on a cable speed command from the winch speed planning module 1212. In one example, the winch 1210 may be a hydraulic winch and the winch speed controller 1214 controls operation of the winch in accordance with the systems, methods, and mechanisms detailed in International Application No. PCT/US2020/065771, published as International Publication No. WO2021/127288 on Jun. 24, 2021, the entirely of which is incorporated by reference herein for all purposes.

Much information can be gathered before and during operation. That information includes: (1) well properties include inclination, surface friction coefficients, liquids inside and their properties; (2) tool physical properties such as weight and geometric dimension; (3) cable properties include line weight and stiffness; and (4) packer physical and geometric properties for pumpdown perforating.

Commands sent from surface includes: (1) for tractor operation, it could include tractor speed command, surface voltage and tractor arm command; and (2) for pumpdown perforating, it could include pumping rate command. Surface measurements include: cable speed and tension; and surface pressure for pumpdown perforating. Downhole measurements may vary depending on the tools, but could include CCL, Gamma ray, head tension, measurements from inertial sensor such as accelerometer and gyroscope, and measurements from magnetometers.

To use the information, a tool states estimation 1205 is created to generate estimation of tool position, speed, and head tension for head tension control from the information. A variety of algorithms such as Luenberger observer, Kalman filter and moving horizon estimation can be used for state estimation.

The tractor 1230 can be controlled via a head tension control system 1250 to follow the motion of the tractor 1230 based on a regulation of a head tension measurement to be within a set target range. In one example, the head tension control system 1250 may access, or otherwise be provided with, estimated tool states and a head tension target. The estimated tool states can be provided from the tool states estimation 1205 described above. The head tension controller 1250 can then generate a tool speed command. The tool speed command, and optionally the estimated tool states, can be provided to the tool speed controller 1236. The tool speed controller 1236 can interpret the tool speed command and generate a tractor command for the tractor 1230. The estimated tool states can include estimated tool speed, tool depth, head tension, and any other properties estimated by the tool states estimation module 1205.

The tractor 1230 can also be controlled by a tractor slippage controller 1270 that can provide a tractor arm force command so that tractor slippage is controlled within a target range. This command can be generated based on receiving data from the tractor 1230 or a sensor associated with the tractor 1230 indicating that the tractor 1230 is experiencing slippage beyond an acceptable range.

Figure 11:
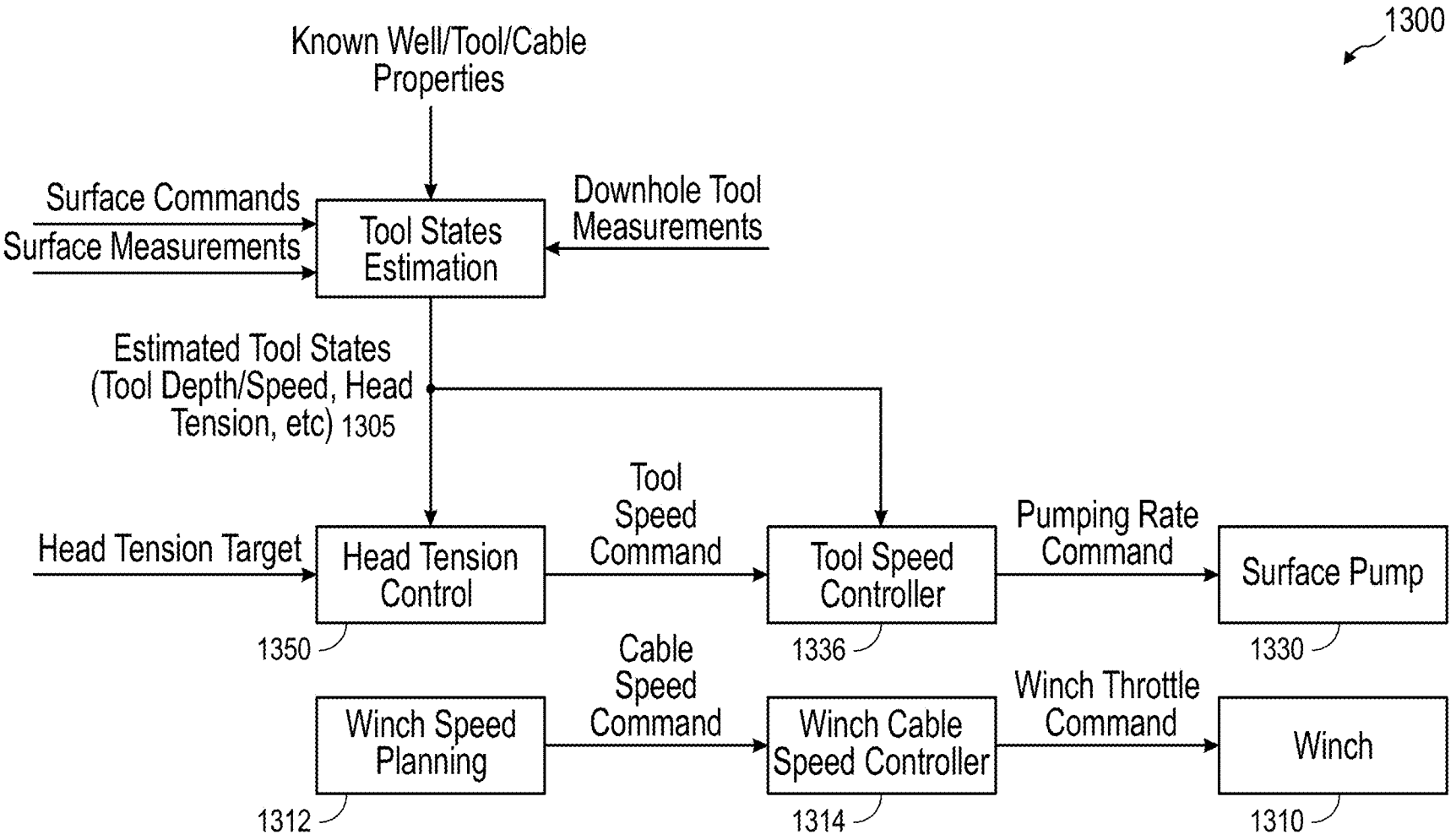
FIG. 11 is a schematic of an exemplary wireline system including a head tension control system, according to an aspect of the present disclosure.

FIG. 11 is a schematic of an exemplary wireline system 1300 including a head tension control system 1350, according to an aspect of the present disclosure. The system 1300 of FIG. 11 is similar to the system 1200 of FIG. 10 but includes a surface pump rather than a tractor for advancing the tool within the wellbore. In the wireline system 1300 of FIG. 11, a surface pump 1330 is operated independently of a winch 1310. A winch speed planning module 1312 may be configured to generate and transmit a cable speed command to a winch cable speed controller 1314, causing the winch cable speed controller 1314 to interpret the command and send a corresponding winch throttle command to the winch 1310 to accelerate or decelerate the cable speed to be within a desired speed range. The winch cable speed controller 1314 can thereby vary the speed of the winch 1310 based on a cable speed command from the winch speed planning module 1312. In one example, the winch 1310 may be a hydraulic winch and the winch speed controller 1314 controls operation of the winch in accordance with the systems, methods, and mechanisms detailed in International Application No. PCT/US2020/065771, published as International Publication No. WO2021/127288 on Jun. 24, 2021, the entirely of which is incorporated by reference herein for all purposes.

Much information can be gathered before and during operation. That information includes: (1) well properties include inclination, surface friction coefficients, liquids inside and their properties; (2) tool physical properties such as weight and geometric dimension; (3) cable properties include line weight and stiffness; and (4) packer physical and geometric properties for pumpdown perforating.

Commands sent from surface includes: (1) for tractor operation, it could include tractor speed command, surface voltage and tractor arm command; and (2) for pumpdown perforating, it could include pumping rate command. Surface measurements include: cable speed and tension; and surface pressure for pumpdown perforating. Downhole measurements may vary depending on the tools, but could include CCL, Gamma ray, head tension, measurements from inertial sensor such as accelerometer and gyroscope, and measurements from magnetometers.

To use the information, a tool states estimation 1305 is created to generate estimation of tool position, speed, and head tension for head tension control from the information. A variety of algorithms such as Luenberger observer, Kalman filter and moving horizon estimation can be used for state estimation.

The pump 1330 can be controlled via a head tension control system 1350 to follow the motion of the toolstring based on a regulation of a head tension measurement to be within a set target range. In one example, the head tension control system 1350 may access, or otherwise be provided with, estimated tool states and a head tension target. The estimated tool states can be provided from the tool states estimation 1305 described above. The head tension controller 1350 can then generate a tool speed command. The tool speed command, and optionally the estimated tool states, can be provided to the tool speed controller 1336. The estimated tool states can include estimated tool speed, tool depth, head tension, and any other properties estimated by the tool states estimation module 1305. The tool speed controller 1336 can interpret the tool speed command and generate a pumping rate command for the pump 1330. In this manner, the tool speed controller 1336 translates a tool speed command into a pumping rate command.

Figure 12:
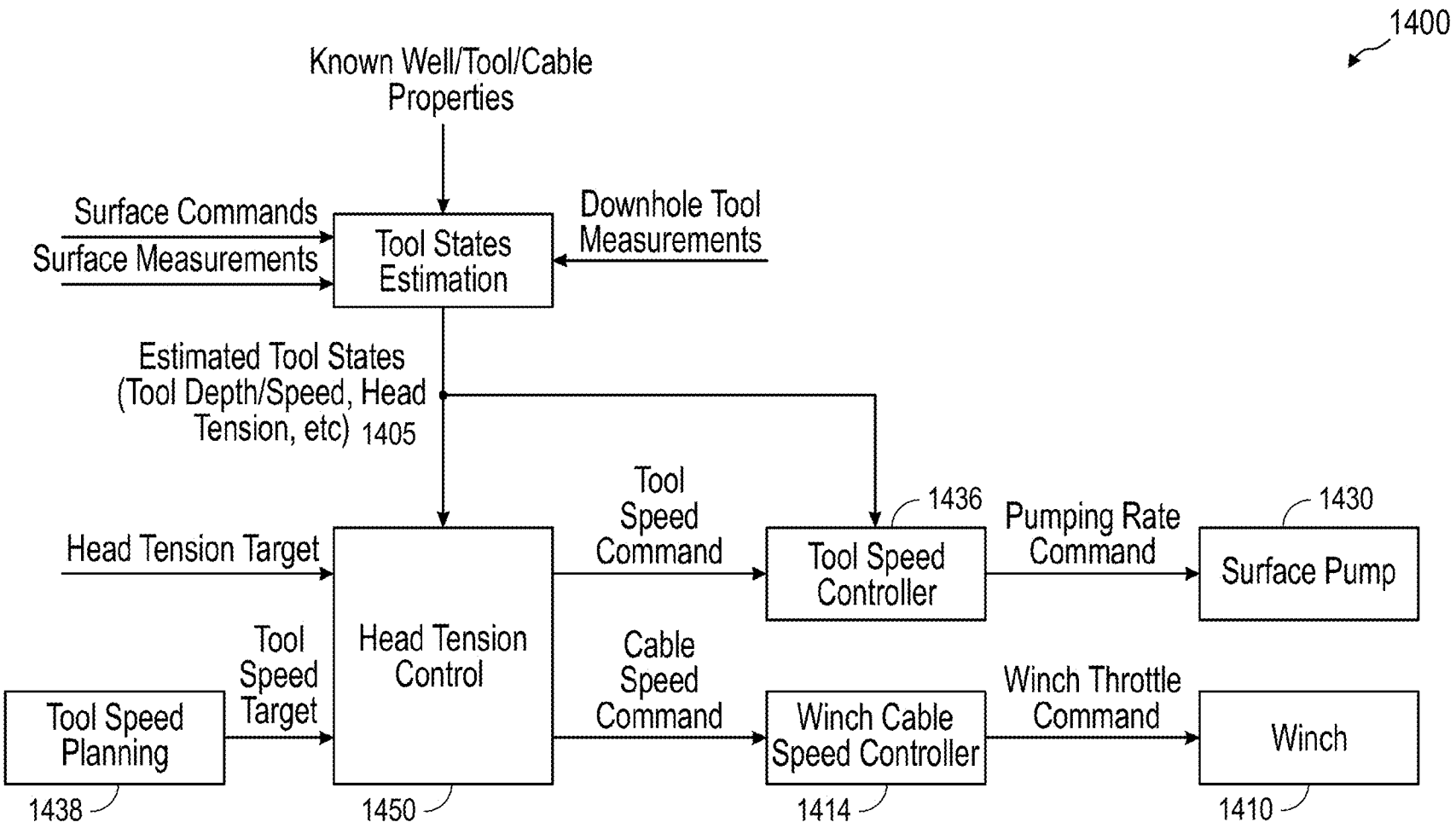
FIG. 12 is a schematic of an exemplary wireline system including a head tension control system, according to an aspect of the present disclosure.
Figure 13:
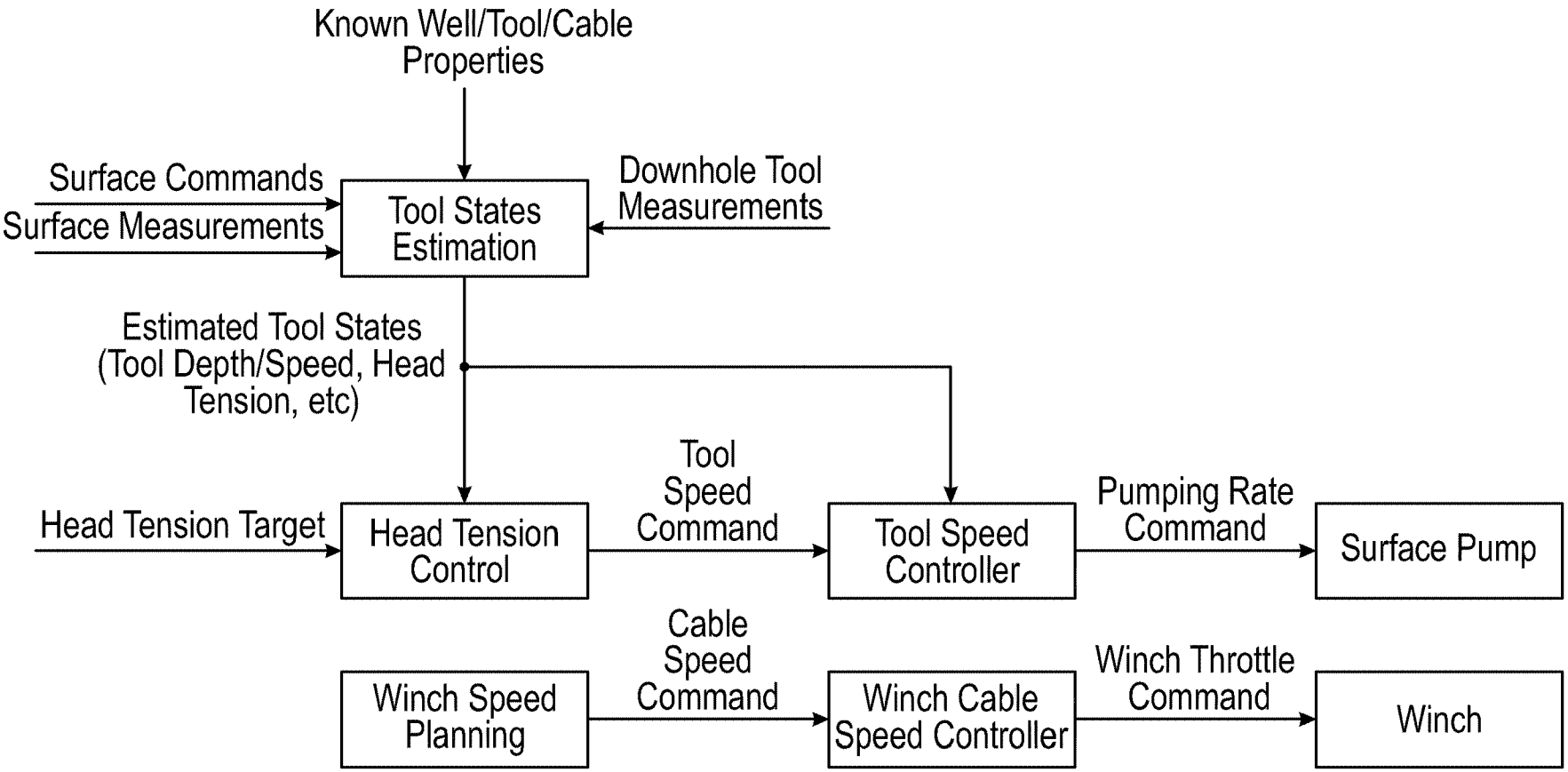
Figure 14:
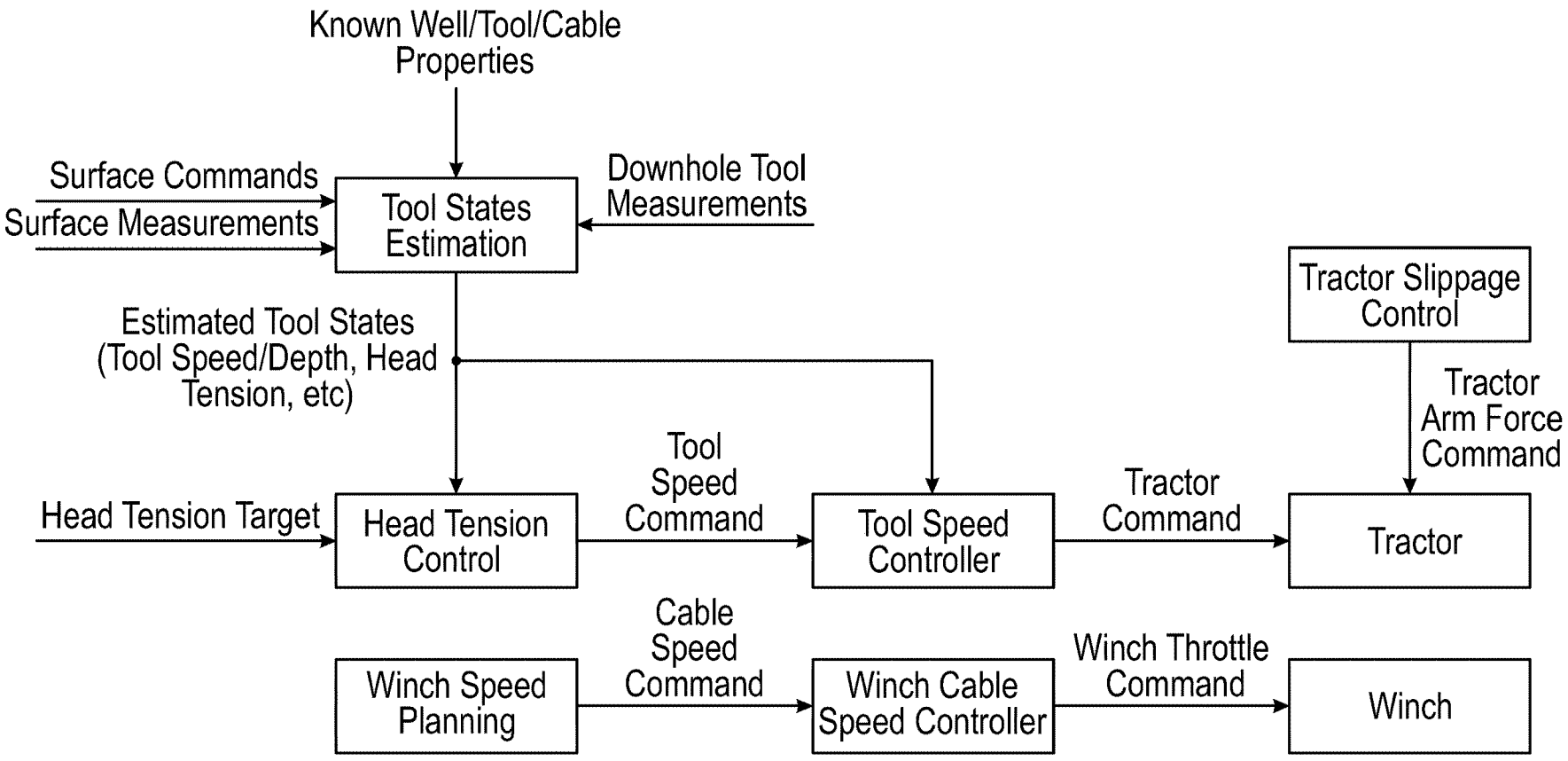
Figure 15:
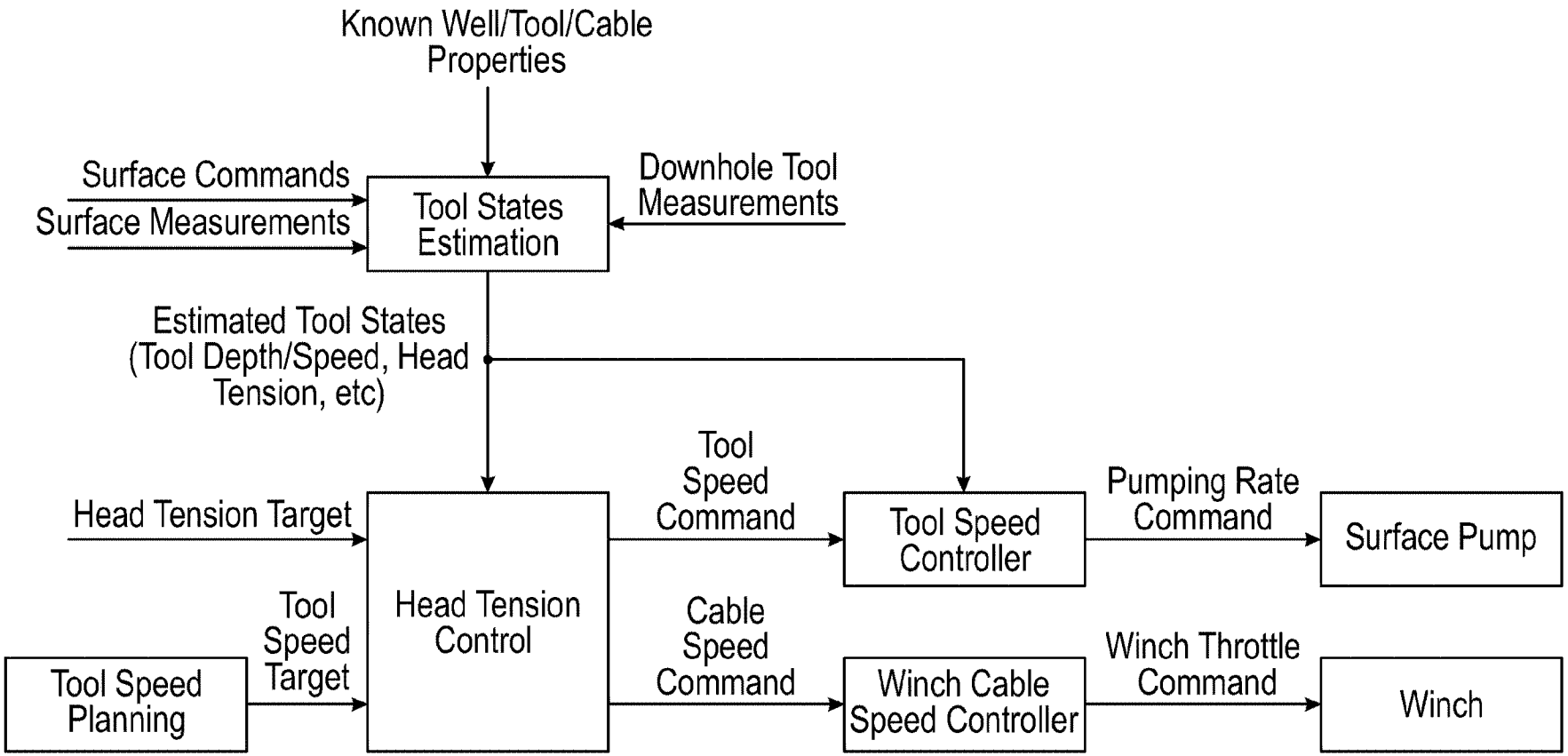

FIG. 12 is a schematic of an exemplary wireline system 1400 including a head tension control system 1450, according to an aspect of the present disclosure. The system 1400 of FIG. 12 is similar to that of FIG. 11, but the system 1400 of FIG. 12 relies on a head tension control system 1450 to control both the surface pump 1430 and the winch 1410, though each is still operated independently. As explained in FIG. 11, a tool state estimation 1405 can be created to generate estimation of tool position, speed, and head tension for head tension control from the information gathered before and during operation. A variety of algorithms such as Luenberger observer, Kalman filter and moving horizon estimation can be used for state estimation. The information can include (1) well properties include inclination, surface friction coefficients, liquids inside and their properties; (2) tool physical properties such as weight and geometric dimension; (3) cable properties include line weight and stiffness; and (4) packer physical and geometric properties for pumpdown perforating, for example.

The tool state estimation 1405 can be provided to the head tension controller 1450 and optionally to a tool speed controller 1436. The head tension controller 1450 can also receive a tool speed target from a tool speed planning module 1438. The tool speed planning module 1438 can provide the tool speed target based on information indicating the state of the tool, such as to slow down, speed up, or stop the tool from advancing within the wellbore.

The head tension controller 1450 can generate a cable speed command which is transmitted to the winch cable speed controller 1414, causing the winch cable speed controller 1414 to interpret the command and send a corresponding winch throttle command to the winch 1410 to accelerate or decelerate the cable speed to be within a desired speed range. The winch cable speed controller 1414 can thereby vary the speed of the winch 1410 based on a cable speed command from the winch speed planning module 1412. In one example, the winch 1410 may be a hydraulic winch and the winch speed controller 1414 controls operation of the winch in accordance with the systems, methods, and mechanisms detailed in International Application No. PCT/US2020/065771, published as International Publication No. WO2021/127288 on Jun. 24, 2021, the entirely of which is incorporated by reference herein for all purposes.

The head tension controller 1450 can also generate a tool speed command. The tool speed command, and optionally the estimated tool states, can be provided to the tool speed controller 1436. The tool speed controller 1336 can interpret the tool speed command and generate a pumping rate command for the pump 1330. In this manner, the tool speed controller 1336 translates a tool speed command into a pumping rate command.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A method for regulating head tension in a wireline system including a cable operatively attached to a winch and a tool driving equipment, the method comprising:

operating the winch with a cable speed;

operating the tool driving equipment with a tool driving speed;

determining the head tension based on the tool driving speed of the tool driving equipment and the cable speed of the cable as a function of an operation of the winch;

determining a head tension regulation error based on a first comparison of the head tension and a target head tension;

applying a model predictive control framework to the head tension, the tool driving speed, the cable speed, and the head tension regulation error, the model predictive control framework generating an operating zone for the winch and the tool driving equipment, wherein the model predictive control framework solves an objective function that is constrained by at least one of surface tension limits, winch speed limits, winch acceleration and deceleration limits, tractor speed limits, or tractor acceleration and deceleration limits, wherein the operating zone is defined by a first range of speed values for a speed difference between the tool driving speed of the tool driving equipment and the cable speed, and a first range of tension values for a tension difference between the head tension and the target head tension; and adjusting, using the head tension regulation error, the operating of the winch and the tool driving equipment to reduce an actual difference between the tool driving speed of the tool driving equipment and the cable speed to within the first range of speed values of the operating zone.

2. The method of claim 1, wherein the operating zone is a first operating zone and the first range of tension values for the tension difference between the head tension and the target head tension from no head tension regulation error to a minimum head tension regulation error, and wherein operating the winch and the tool driving equipment includes allowing a current operation of the winch and the tool driving equipment to continue.

3. The method of claim 2, wherein the minimum head tension regulation error corresponds to plus or minus a value for a head tension measurement resolution.

4. The method of claim 1, wherein the head tension regulation error corresponds to the head tension being greater than the target head tension, and wherein operating the winch and the tool driving equipment in the operating zone includes operating the winch to have a first speed less than a second speed of the tool driving equipment.

5. The method of claim 1, wherein the head tension regulation error corresponds to the head tension being less than the target head tension, and wherein operating the winch and the tool driving equipment in the operating zone includes operating the winch to have a first speed greater than a second speed of the tool driving equipment.

6. The method of claim 1, wherein the tool driving equipment is a tractor configured to mechanically advance itself within a wellbore.

7. The method of claim 1, wherein the tool driving equipment is a hydraulic pump.

8. The method of claim 1, wherein the tool driving equipment is a device configured to mechanically advance itself within a wellbore using pressurized fluid provided by a hydraulic pump.

9. The method of claim 8, wherein the hydraulic pump is located at a surface outside of the wellbore.

10. A wireline system, the wireline system comprising:

a winch;

a tool string;

a tool driving equipment operatively connected to the tool string;

a cable operatively connected to the winch and the tool driving equipment; and a head tension control system including:

a memory storage including a non-transitory, computer-readable medium comprising instructions, and a computing device including a hardware-based processor;

wherein the hardware-based processor is configured to execute the instructions to carry out stages comprising:

operating the winch with a cable speed;

operating the tool driving equipment with a tool driving speed;

determining a head tension based on the tool driving speed of the tool driving equipment and the cable speed of the cable as a function of an operation of the winch;

determining a head tension regulation error based on a first comparison of the head tension and a target head tension;

applying a model predictive control framework to the head tension, the tool driving speed, the cable speed, and the head tension regulation error, the model predictive control framework generating an operating zone for the winch and the tool driving equipment, wherein the model predictive control framework solves an objective function that is constrained by at least one of surface tension limits, winch speed limits, winch acceleration and deceleration limits, tractor speed limits, or tractor acceleration and deceleration limits, wherein the operating zone is defined by a first range of speed values for a speed difference between the tool driving speed of the tool driving equipment and the cable speed, and a first range of tension values for a tension difference between the head tension and the target head tension; and adjusting, using the head tension regulation error, the operating of the winch and the tool driving equipment to reduce an actual difference between the tool driving speed of the tool driving equipment and the cable speed to within the first range of speed values of the operating zone.

11. The wireline system of claim 10, wherein the operating zone is a first operating zone and the first range of tension values for the tension difference between the head tension and the target head tension from no head tension regulation error to a minimum head tension regulation error, and wherein operating the winch and the tool driving equipment includes allowing a current operation of the winch and the tool driving equipment to continue.

12. The wireline system of claim 11, wherein the minimum head tension regulation error corresponds to plus or minus a value for a head tension measurement resolution.

13. The wireline system of claim 10, wherein the head tension regulation error corresponds to the head tension being greater than the target head tension, and wherein operating the winch and the tool driving equipment in the operating zone includes operating the winch to have a first speed less than a second speed of the tool driving equipment.

14. The wireline system of claim 10, wherein the head tension regulation error corresponds to the head tension being less than the target head tension, and wherein operating the winch and the tool driving equipment in the operating zone includes operating the winch to have a first speed greater than a second speed of the tool driving equipment.

15. The wireline system of claim 10, wherein the tool driving equipment is a tractor configured to mechanically advance itself within a wellbore.

16. The wireline system of claim 10, wherein the tool driving equipment is a hydraulic pump.

17. The wireline system of claim 10, wherein the tool driving equipment is a device configured to mechanically advance itself within a wellbore using pressurized fluid provided by a hydraulic pump.

18. The wireline system of claim 17, wherein the hydraulic pump is located at a surface outside of the wellbore.

* * * * *